US010099359B2

(12) United States Patent
Roberts

(10) Patent No.: US 10,099,359 B2
(45) Date of Patent: Oct. 16, 2018

(54) PNEUMATIC HAMMER

(71) Applicant: Black & Decker Inc., Newark, DE (US)

(72) Inventor: Ana-Maria Roberts, Bury St Edmunds (GB)

(73) Assignee: Black & Decker Inc., New Britain, CT (US)

( * ) Notice: Subject to any disclaimer, the term of this patent is extended or adjusted under 35 U.S.C. 154(b) by 417 days.

(21) Appl. No.: 14/884,906

(22) Filed: Oct. 16, 2015

(65) Prior Publication Data

US 2016/0107303 A1 Apr. 21, 2016

(30) Foreign Application Priority Data

Oct. 20, 2014 (GB) ..... 1418561.5

(51) Int. Cl.
*B25D 16/00* (2006.01)
*B25F 5/00* (2006.01)

(52) U.S. Cl.
CPC ..... *B25D 16/006* (2013.01); *B25F 5/001* (2013.01); *B25D 2211/068* (2013.01);
(Continued)

(58) Field of Classification Search
CPC ..... B25D 16/006; B25D 2211/068; B25D 2211/0015; B25D 2211/0023; B25D 2211/0038; B25D 2211/0046; B25F 5/001
(Continued)

(56) References Cited

U.S. PATENT DOCUMENTS 4,346,769 A * 8/1982 Simpson ..... B25D 16/00 173/100
4,763,733 A * 8/1988 Neumaier ..... B25D 16/006 173/109

(Continued)

FOREIGN PATENT DOCUMENTS

| | | |
|---|---|---|
| DE | 10 2004 055 236 | 5/2006 |
| DE | 10 2010 062 104 | 5/2012 |
| JP | H10-180513 | 7/1998 |

OTHER PUBLICATIONS

European search report dated Mar. 1, 2016 issued in corresponding EP patent application.

(Continued)

*Primary Examiner* — Michelle Lopez
(74) *Attorney, Agent, or Firm* — Amir Rohani

(57) ABSTRACT

A pneumatic hammer has a conversion mechanism with a rotatable input member coupled to the motor and adapted to convert a rotational movement of the input member into a reciprocating movement of an output member. The input member is formed as a first carrier which supports a first planet gear. A first sun gear is coaxially arranged with the first carrier, and is rotatingly driven by the drive motor. A first ring gear is movable parallel to the first axis of rotation between a first position and a second position. A second gear is rotatable around a second axis of rotation parallel to the first axis of rotation. The second gear meshingly engages with the first ring gear when the first ring gear is in the second position, and is disengaged from the first ring gear when the first ring gear is in the first position.

16 Claims, 1 Drawing Sheet

(52) U.S. Cl.
CPC ..... *B25D 2216/0015* (2013.01); *B25D 2216/0023* (2013.01); *B25D 2216/0038* (2013.01); *B25D 2216/0046* (2013.01)

(58) Field of Classification Search
USPC ..... 173/47, 216
See application file for complete search history.

(56) References Cited

U.S. PATENT DOCUMENTS

| | | | | |
|---|---|---|---|---|
| 2005/0224242 | A1* | 10/2005 | Britz ..... | B25D 16/006 173/15 |
| 2006/0108133 | A1* | 5/2006 | Yamazaki ..... | B25D 11/005 173/104 |
| 2012/0186842 | A1 | 7/2012 | Wiedemann et al. | |
| 2015/0000947 | A1 | 1/2015 | Herr et al. | |

OTHER PUBLICATIONS

Great Britain search report dated Mar. 7, 2016 issued in corresponding GP application.

* cited by examiner

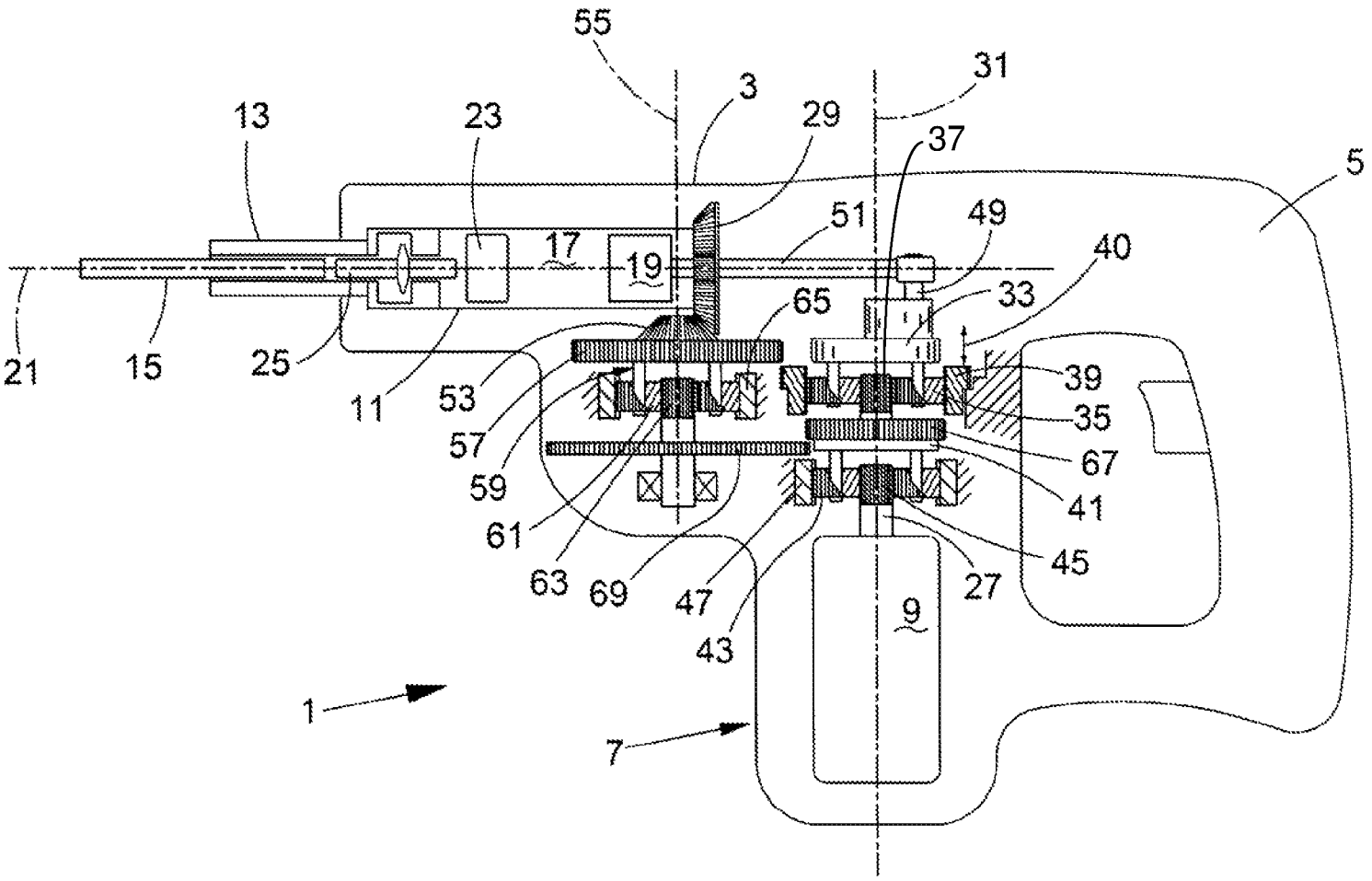
5
40
39
35
67
41
45
31
49
33
27
37
9
51
29
65
3
47
43
55
19
69
7
17
63
61
23
59
57
53
11
1
25
13
15
21

PNEUMATIC HAMMER

BACKGROUND

Pneumatic hammers with a housing, a drive motor arranged in the housing, an output spindle supporting a tool holder for a tool bit, a hammer mechanism comprising a cylinder in which a reciprocatingly driven piston and ram are arranged wherein in the cylinder an air cushion is formed between the piston and the ram so that the ram reciprocates upon reciprocating movement of the piston and imparts impacts on a tool bit supported in the tool holder, a conversion mechanism with a rotatable input member coupled to the drive motor and being adapted to convert a rotational movement of the input member into a reciprocating movement of an output member which is coupled with the piston, wherein the spindle is coupled with a rotatable drive member coupled with the drive motor so that rotation of the drive member effects rotation of the spindle, are well known in the prior art. The hammer mechanism typically has a cylinder in which a piston and a ram are slidably supported so that they may conduct a sliding movement along a longitudinal axis of the cylinder. The ram may directly or indirectly, via a beat piece, get into contact with the rear end of a tool bit so as to impart axial impacts on the tool bit.

To this end an air cushion is formed in the cylinder between the piston and the ram, and the piston is reciprocatingly driven by a conversion mechanism which converts a rotational movement generated by a drive motor into a reciprocating movement. Such mechanisms are well known, e.g. wobble drive mechanisms and crank drive mechanisms. The latter employ a crank plate which is rotationally driven and provided with an eccentrically arranged crank pin. That pin is connected to the rear end of the piston by a connecting rod so that rotation of the crank plate effects a reciprocating motion of the piston. This motion is transferred to the ram via the air cushion between the piston and the ram so that the ram conducts a reciprocating movement as well. During the forward movement it collides directly or indirectly with the rear end of the tool bit which is axially slidable supported in the tool holder. Further, the output spindle on which the tool holder is supported and to which the cylinder is connected, may also be rotationally driven, so as to allow for a drilling operation of the tool bit.

Such hammers allow for different modes of operation such as a hammer drill mode in which the tool bit supported in the tool holder is rotationally driven and at the same time axial impacts are imparted on the tool bit via the hammer mechanism. Further, in a drilling mode, the hammer mechanism is deactivated so that the tool bit is rotationally driven only. Finally, such hammers also allow for a chisel mode in which only axial impacts are imparted on the tool bit by the hammer mechanism whereas the tool bit is not rotationally driven.

Further, such hammers may be operated such that the output spindle may rotate in forward and reverse directions. This is for example advantageous if the tool bit must be retracted from a workpiece. To this end a first option is that the drive motor is capable of driving the armature in different rotational directions. In case of a brushed motor this requires that e.g. a corresponding mechanical assembly is provided which allows to switch between different angular positions of the brush support with respect to the stator. However such mechanisms are complicated and subject to wear when the tool is used in dust-laden environments. Another option is to employ a brushless motor but in this case the electronics need to be adapted correspondingly.

Another option to allow for forward and reverse rotation of the output spindle is that the gear set is designed such that it has different settings for forward and reverse rotation. However, such a separate stage in the gear set is disadvantageous both from a cost perspective and in view of the additional weight and space required.

SUMMARY

A pneumatic hammer comprising a housing, a drive motor arranged in the housing, an output spindle supporting a tool holder for supporting a tool bit, a hammer mechanism comprising a cylinder in which a reciprocatingly driven piston and a ram are arranged wherein in the cylinder an air cushion is formed between the piston and the ram so that the ram reciprocates upon reciprocating movement of the piston and imparts impacts on a tool bit supported in the tool holder, a conversion mechanism comprising a rotatable input member coupled to the drive motor and being adapted to convert a rotational movement of the input member into a reciprocating movement of an output member which is coupled with the piston, wherein the spindle is coupled with a rotatable drive member coupled with the drive motor so that rotation of the drive member effects rotation of the spindle, wherein the input member is formed as a first carrier which eccentrically supports a rotatable first planet gear and is rotatable around a first axis of rotation, wherein a first sun gear is coaxially arranged with the first carrier and meshingly engages with the first planet gear, the first sun gear being rotatingly driven by the drive motor, wherein a first ring gear is coaxially arranged with the first axis of rotation, is movable parallel to the first axis of rotation between a first position and a second position and in the first and second positions meshingly engages with the first planet gear, wherein the drive member is formed as a second gear rotatable around a second axis of rotation parallel to the first axis of rotation, wherein the second gear meshingly engages with the first ring gear when the first ring gear is in the second position, and is disengaged from the first ring gear when the first ring gear is in the first position, wherein the second gear comprises a coupling section connected with the drive motor via a releasable connection which has an open state in which the second gear is not rotatingly driven by the drive motor, and a closed state in which the second gear is rotatingly driven by the drive motor, and wherein the hammer comprises a mode change mechanism which has (a) a first setting (hammer drill mode) in which the first ring gear is in the first position and locked with respect to the housing and the connection is in the closed state,
(b) a second setting (drill mode) in which the first ring gear is in the first position and freely rotatable with respect to the housing and the connection is in the closed state,
(c) a third setting (chisel mode) in which the first ring gear is in the first or second position and locked with respect to the housing and the connection is in the open state, and
(d) a fourth setting (reverse rotation mode) in which the first ring gear is in the second position and rotatable with respect to the housing and the connection is in the open state.

Accordingly the first ring gear may be axially movable between a first position and a second position. In the first position the first ring gear is either fixed or freely rotatable and does not engage with the second gear whereas in the second position it meshingly engages with the second gear that is coupled with the spindle.

When the first ring gear is in the first position the conventional modes of operation of a pneumatic hammer can be selected by the mode change mechanism, namely the hammer drill mode, the drill mode and the chisel mode as above described.

To this end the mode change mechanism is configured such that in the first setting (hammer drill mode) of the mechanism, the first ring gear is locked with respect to the housing so that torque is transferred from the drive motor to the rotatable input member via a first planetary gear stage formed by the first sun gear, the first ring gear, the first planet gear and the rotatable input member which acts as a planet carrier. At the same time the mode change mechanism actuates the releasable connection so that it is closed and the second gear is driven by the drive motor and the output spindle rotates. In this setting a tool bit supported in the tool holder is rotated and axial impacts are imparted on it.

In the second setting (drill mode) of the mode change mechanism the first ring gear is in the first position but can freely rotate so that no torque is transferred to the rotatable input member via the first planetary gear stage and no impacts are imparted on the tool bit. In this setting the releasable connection is also actuated such by the mode change mechanism that it is in the closed position to rotationally drive the output spindle to rotate the tool bit.

Further, the mode change mechanism is configured such that in its third setting (chisel mode) the first ring gear is either in the first position or, as an alternative, in the second position so that it engages with the second gear. In any case, when being in the third setting the mode change mechanism ensures that the first ring gear is prevented from rotation with respect to the housing so that the rotatable input member is rotationally driven via the first planetary gear set so that axial impacts are imparted on the tool bit. As the mode change mechanism is adapted such that in the third setting the releasable connection coupling the second gear with the drive motor is in the open state, the output spindle is not rotated.

Here, the design of the drive train according to the present invention allows for the following two options. In the third setting the first ring gear could either be in the first or in the second position. When it is in the first position the output spindle can be freely rotated and the angular position of the tool bit such as a chisel may be adjusted. On the other hand, the first ring gear can also be set in the second position so that the rotationally fixed first ring gear engages with the second gear and that the latter and the output spindle are prevented from rotation and the angular position of the tool bit is fixed.

Therefore, when the chisel mode is chosen the drive train according to the present invention provides a mechanism to rotationally lock or release the output spindle without additional mechanical means by simply having means to switch the first ring gear between the first and second positions when the third setting is chosen.

Finally, when the mode change mechanism is set to the fourth setting (reverse rotation mode) it shifts the first ring gear to the second position but allows for a rotation of the first ring gear with respect to the housing. At the same time the releasable connection coupling the second gear with the drive motor is moved to the open state. With this adjustment of the first ring gear torque may be transmitted to the output spindle via the first sun gear and the first planet gear while the first carrier is preferably prevented from rotation by means that lock the first carrier with respect to the housing when the mode change mechanism is in the fourth setting.

Thus, in the fourth setting an additional path is provided for transferring torque from the drive motor to the second gear which path can be configured such that the rotational direction with which the output spindle rotates when being driven through this additional path is different from the rotational direction of the output spindle when driven via the releasable connection even though in either case the rotational direction of the armature of drive motor is the same.

Therefore, it becomes possible with such configuration that an element of the planetary gear set which is connected to the conversion mechanism can be used to transfer torque to the output spindle and to drive it in reverse direction. Reverse rotation of the output spindle can be achieved without reversing the rotational direction of the armature and without a complicated mechanical assembly added to the drive train. Instead simply the first ring gear in the torque path to the conversion mechanism for the hammer mechanism needs to be adapted to assume first and second positions. At the same time a simple option is provided to prevent the output spindle from rotation when the hammer is in chisel mode.

In an embodiment the coupling section of the second gear is formed as a second carrier which supports eccentrically with respect to the second axis of rotation a rotatable second planet gear wherein a second sun gear is coaxially arranged with respect to the second axis of rotation and meshingly engages with the second planet gear, the second sun gear being rotatingly driven by the drive motor, wherein a second ring gear is coaxially arranged with respect to the second axis of rotation and meshingly engages with the second planet gear.

In an alternative embodiment in the closed state of the connection the second ring gear is locked with respect to the housing, and wherein in the open state of the connection the second ring gear is freely rotatable with respect to the housing.

In this embodiment the torque path for directly driving the output spindle in forward direction comprises an additional planetary gear stage which allows to reduce the speed of the output spindle and increase the torque compared to the output of the drive motor. Further, by providing means to release or lock the second ring gear with respect to the tool housing the releasable connection can be formed in simple manner.

Further, it is preferred that on the first sun gear a first gear element is formed on the side opposite the first carrier, and on the second sun gear a second gear element is formed on the side opposite the second carrier, wherein the first and the second gear elements are in meshing engagement. In such an arrangement of the first and second gear element can be directly coupled to the drive motor so that it is rotationally driven. In this case a simple arrangement is formed in which the rotational direction of the output spindle is reversed when torque is transferred to the output spindle via the first ring gear when being in engagement with the second gear rather than via the releasable connection between the second gear and the drive motor.

Preferably in the closed state of the connection the first gear element is in meshing engagement with the second gear element whereas in the open state of the connection the first gear element and the second gear element are disengaged. This can be achieved in such a way that the second gear element is movable along the second axis between a first position, in which the second gear element meshingly engages with the first gear element, and a second position in which the first and second gear elements are disengaged.

In another embodiment a third carrier is formed on the first sun gear opposite the first carrier, wherein the third carrier supports eccentrically with respect to the first axis of rotation a rotatable third planet gear, wherein a third sun gear is coaxially arranged with the first axis of rotation and meshingly engages with the third planet gear, the third sun gear being coupled to an armature of the drive motor, wherein a third ring gear is coaxially arranged with the first axis of rotation and meshingly engages with the third planet gear, the third ring gear being locked with respect to the housing. Such an arrangement leads to an increase of the torque and a reduction of the rotational speed at the input of the drive train according to the present invention.

Further, to facilitate the above mentioned settings means are provided which are adapted to selectively lock or to allow rotation of the first ring gear with respect to the housing when the first ring gear is in the first position or in the second position. Thus, both in the first and the second position of the first ring gear may be locked or can freely rotation depending on the adjustment of the respective means.

In particular, the aforementioned means and the mode change mechanism can be designed such that the first ring gear when being in the first position can be switched between a locked position in which the first ring gear is locked with respect to the housing, and a release position in which the first ring gear is freely rotatable with respect to the housing, wherein in the first setting the first ring gear is in the locked position, wherein in the second setting the first ring gear is in the release position and wherein in the third setting when the first ring gear is in the first position the first ring gear is in the locked position.

Similarly, it is preferred that the first ring gear when being in the second position can be switched between a locked position in which the first ring gear is locked with respect to the housing, and a release position in which the first ring gear is freely rotatable with respect to the housing, wherein in the third setting when the first ring gear is in the second position the first ring gear is in the locked position, wherein in the fourth setting when the ring gear is in the second position the second ring gear is in the release position.

In both cases, the respective switching means can be formed such that in the first and/or the second position of the first ring gear the latter is axially movable so that it may selectively engage with engagement members fixed to the housing which members prevent the first ring gear from rotation. As an alternative a rotationally fixed but axially movable sleeve member may selectively engage with the first ring gear.

Moreover, the conversion mechanism may comprise an eccentric pin on the first carrier opposite to the first planet gear wherein a connecting rod connects the eccentric pin and the piston and forms the output member. Thus, preferably the conversion mechanism employs the concept of a crank drive. However, it is conceivable without departing from the scope of the present invention to use a wobble plate assembly.

In an embodiment drive member or second gear is formed as a bevel gear which engages with a spindle bevel gear coupled to the spindle and having a third axis rotation perpendicular to the second axis of rotation. In particular, the second bevel gear may surround the spindle.

Finally, the output spindle may be formed as a hollow spindle having at the end opposite the tool holder a tubular portion wherein the cylinder of the hammer mechanism is formed by the tubular portion.

BRIEF DESCRIPTION OF THE DRAWING

An embodiment of the present invention will now be described by way of example only with reference to the accompanying drawing in which FIG. 1 is a sectional view of a pneumatic hammer.

DETAILED DESCRIPTION

Referring to FIG. 1, the hammer 1 comprises a housing 3 which is provided with a handle portion 5 at the rear end and motor housing portion 7 at the lower part. In the housing 3 a drive train is arranged which comprises a drive motor 9 in the form of an electric motor and a hollow output spindle 11 rotatably supported in the housing 3. At the front end of the output spindle 11 a tool holder 13 is fixedly mounted which is designed such that a tool bit 15 may be supported in the tool holder 13 in such a manner that it is rotationally fixed but may slide in the tool holder 13 in the axial direction of the output spindle 11 to an extent defined by the tool holder 15.

Inside the hollow output spindle 11 a cylinder 17 is preferably formed in which a piston 19 may be slidably supported so that it may move along the longitudinal axis 21 of the output spindle 11. Between the piston 19 and the front end of the spindle 11 with the tool holder 13 a ram 23 and a beat piece 25 are preferably arranged inside the spindle 11 wherein an air cushion is formed between the piston 19 and the ram 23 so that, when the piston 19 is reciprocatingly driven, the ram 23 will reciprocate or move back and forth as well. When the ram 23 during a back and forth movement slides towards the front, it will hit the rear end of the beat piece 25 and an axial impact is imparted to the beat piece 25. This impact is then transferred to the tool bit 15 and on a workpiece (not shown).

To achieve a reciprocating movement of the piston 19, a conversion mechanism is preferably provided which converts the rotational movement of the armature 27 of the drive motor 9 into a reciprocating movement and which will be described in detail below. The general concept of such a hammer mechanism is well known in the prior art and does not require further explanation.

At the rear end the hollow spindle 11 is provided with a spindle bevel gear 29 which surrounds the spindle 11 so that the output spindle 11 may rotationally be driven by the drive motor 9, and the coupling between the drive motor 9 and spindle bevel gear 29 will be described in detail below.

In this embodiment of a pneumatic hammer 1 the drive motor 9 is arranged in the housing 3 in such a manner that the armature 27 extends along first axis 31 which is perpendicular to the axis 21 along which the output spindle 11 extends. The drive motor 9 is coupled to the piston 19 and the spindle bevel gear 29 so as to effect a reciprocating movement and rotation, respectively, by the arrangement as described in the following.

On the first axis 31 a rotatable input member in the form of a first carrier 33 may be rotatably mounted with respect to this axis inside the housing 3. On the side of the first carrier 33 facing towards the drive motor 9 the first carrier 33 eccentrically rotatably supports first planet gears 35. A first sun gear 37 may be coaxially arranged with the first carrier 33 and meshingly engages with the first planet gears 35.

Finally, a first ring gear 39 preferably coaxially arranged with the first axis of rotation 31 is movable parallel to the first axis 31 between a first position and a second position as indicated by the arrow 40. Both in the first and second positions the first ring gear 39 meshingly engages with the first planet gears 35.

A mechanism is provided (but not shown in detail) which are adapted to selectively lock or to allow rotation of the first ring gear 39 with respect to the housing 3 when the first ring gear 39 is in the first position or in the second position, as is well known in the art. In addition, a mechanism is provided that may lock the first carrier 33 with respect to the housing 3.

The first sun gear 37 may be formed on a carrier 41 which is preferably rotatably supported in the housing 3 with respect to the first axis 31, wherein the carrier 41 on the side remote from the first carrier 33 and opposite the first sun gear 37 supports eccentrically with respect to the first axis 31 rotatable planet gears 43. A further sun gear 45 may be coaxially arranged with the first axis 31 and meshingly engages with the third planet gears 43 supported on the carrier 41. The sun gear 45 is preferably coupled to the armature 27 of the drive motor 9, and could be integrally formed therewith.

Further, a further ring gear 47 may be coaxially arranged with the first axis 31 and meshingly engaged with the planet gears 43, this ring gear 47 being rotationally fixed with respect to the housing 3.

Finally, an eccentric pin 49 may be provided on the first carrier 33 opposite to the first planet gears 35 wherein a connecting rod 51 connects the eccentric pin 49 with the rear end of the piston 19 and forms an output member. Thus, rotation of the first carrier 33 or input member is preferably converted into a reciprocating movement of the piston 19 via the arrangement of the eccentric 49 and the connecting rod 51 which form a conversion mechanism.

Thus, when the first ring gear 39 is locked with respect to the housing 3 and the armature 27 of the drive motor 9 rotates, i.e. the drive motor 9 is switched on, the first carrier rotates and the piston 19 is reciprocatingly driven which in turn results in a movement back and forth of the ram 23 so that impacts are imparted on the tool bit 15 via the beat piece 25. However, when the first ring gear 39 is released so that it may rotate with respect to the housing 3, no torque will be transmitted to the first carrier 33 and the hammer mechanism will be deactivated when the armature 27 rotates.

Furthermore, the spindle bevel gear 29 meshingly engages with a drive member formed as a bevel gear 53 which is rotatably supported in the housing with respect to second axis 55, the second axis 55 being parallel to and at a distance from the first axis 31. Formed in one piece with the bevel gear 53 is a second gear 57 having an outer toothing.

The first ring gear 39 is provided with an outer toothing as well and when the first ring gear 39 is in the second position (not shown in FIG. 1) the outer toothings of the first ring gear 39 and the second gear 57 meshingly engage, whereas the first ring gear 39 and the second gear 57 are disengaged when the first ring gear 39 is in the first position (see FIG. 1).

Moreover a coupling section is provided which connects the second gear 57 and the drive motor 9 via a releasable connection which has an open state in which the second gear 57 is not rotatingly driven by the drive motor 9, and a closed state in which the second gear 57 is rotatingly driven by the drive motor 9.

The coupling section may comprise a second carrier 59 formed on the second gear 57 and rotatably supporting second planet gears 61, which are eccentrically arranged with respect to the second axis 55. Further a second sun gear 63 is coaxially arranged with the second axis 55 and meshingly engages with the second planet gears 61. Finally, a second ring gear 65 is coaxially arranged with respect to the second axis 55 and meshingly engages with the second planet gears 61.

On the carrier 41 which may be integrally formed with the first sun gear 37, a first gear element 67 is formed as an outer toothing. Further, the second sun gear 63 is preferably integrally formed with a second gear element 69 positioned on the side remote from the second carrier 59, wherein the first and the second gear elements 67, 69 may meshingly engage.

In the closed state of the connection, the first gear element 67 is preferably in meshing engagement with the second gear element 69 (not shown) whereas in the open state of the connection the first gear element and the second gear element are disengaged. In particular, the second gear element 69 together with the second sun gear 63 is preferably movable along the second axis 55 between a first position, in which the second gear element 69 meshingly engages with the first gear element 67, and a second position in which the first and second gear elements 67, 69 are preferably disengaged (see FIG. 1). The releasable connection may be formed by the axially movable combination of the second sun gear 63 and the second gear element 69.

While not shown, as an alternative for the described releasable connection it is conceivable that the second ring gear 65 is releasably supported in the housing 3 so that it may rotate, and in the closed state of the connection the second ring gear 65 is locked with respect to the housing 3, whereas in the open state of the connection the second ring gear 65 is freely rotatable with respect to the housing 3.

Thus, if the releasable connection is in the closed state, i.e. the first and second gear elements 67, 69 are in meshing engagement and the second ring gear 65 cannot rotate, torque may be transmitted from the armature 27 via planet gears 43, the carrier 41 and the first gear element 67 to the second gear element 69, from which the torque is transferred to the output spindle 11 via the second planet gears 61 and the bevel gears 53, 29.

A mode change mechanism which is not shown in the figures is preferably adapted to (a) selectively shift the first ring gear 39 between the first and second positions, (b) lock or release the first ring gear 39 with respect to the housing 3 so that it is either prevented from rotation or may freely rotate with respect to the housing 3, (c) lock or release the first carrier 33 with respect to the housing 3, so that it is either prevented from rotation or may freely rotate, and (d) switch between the open and closed state, i.e. to axially move the combination of the second gear element 69 and the second sun gear 63 between the first and second positions. Therefore, such drive train allows for a first setting (hammer drill mode) in which the first ring gear 39 is in the first position and locked with respect to the housing 3 and the connection is in the closed state.

With this setting when the armature 27 rotates torque is transferred from the drive motor 9 to the first carrier 33 via a first planetary gear stage formed by the first sun gear 37, the first ring gear 39, the first planet gears 35 and a further planetary gear stage formed by the sun gear 45, the ring gear 47 and the planet gears 43. This leads to a reciprocating movement of the piston 19. At the same time, as the releasable connection is closed, the second gear 57 and the bevel gear 53 are driven by the drive motor 9 and the output spindle 11 rotates. In this setting the tool bit 15 supported in the tool holder 13 is rotated and axial impacts are imparted on it.

Such drive train may also allow for a second setting (drill mode) in which the first ring gear 39 is in the first position and freely rotatable with respect to the tool housing 3 and the connection is in the closed state. In this case the first carrier 33 is not rotationally driven so that the piston 19 is kept stationary. In this setting the tool bit 15 is merely rotationally driven.

Such drive train may also allow for a third setting (chisel mode) in which the first ring gear 39 is in the first or second position but locked with respect to the tool housing 3 and the connection is in the open state.

Thus, the mode change mechanism is configured such that in its third setting (chisel mode) the first ring gear 39 is either in the first position or, as an alternative, in the second position so that it engages with the second gear 57.

In any case, when in the third setting the mode change mechanism ensures that the first ring gear 39 is prevented from rotation with respect to the housing 3 so that the first carrier 33 is rotationally driven via the first planetary gear stage so that axial impacts are imparted on the tool bit 15. As the mode change mechanism is adapted such that in the third setting the releasable connection coupling the second gear 57 with the drive motor 9 is preferably in the open state, the output spindle 11 is not rotated.

The design of the drive train further allows for the following two options: in the third setting the first ring gear 39 could either be in the first or in the second position. When it is in the first position the output spindle 11 can be freely rotated and the angular position of the tool bit 15 such as a chisel may be adjusted. On the other hand, the first ring gear can also be set in the second position so that the rotationally fixed first ring gear 39 engages with the second gear 57 so that the latter and the output spindle 11 are prevented from rotation and the angular position of the tool bit 15 is fixed. Therefore, when the chisel mode is chosen the drive train preferably provides a mechanism to rotationally lock or release the output spindle 11 without additional mechanical means by simply having means to switch the first ring gear 39 between the first and second positions when the third setting is chosen.

The drive train further allows for a fourth setting (reverse rotation mode) in which the first ring gear 39 is in the second position and rotatable with respect to the tool housing 3 and the connection is in the open state. When the mode change mechanism is set to the fourth setting (reverse rotation mode) it preferably shifts the first ring gear 39 to the second position but allows for a rotation of the first ring gear 39 with respect to the tool housing 3. At the same time the releasable connection coupling the second gear 57 with the drive motor is preferably moved to the open state, i.e. the combination of the second gear element 69 and the second sun gear 63 is shifted such that the first and second gear elements 67, 69 do not engage.

With this adjustment of the first ring gear 39, torque may be transmitted to the output spindle 11 via the first sun gear 37 and the first planet gears 35 while the first carrier 33 is preferably prevented from rotation by the means that lock the first carrier 33 with respect to the housing when the mode change mechanism is in the fourth setting. Thus, in the fourth setting an additional path is provided for transferring torque from the drive motor 9 to the second gear 57 which path is configured such that the rotational direction with which the output spindle 11 rotates when being driven through this additional path is different from the rotational direction of the output spindle 11 when driven via the releasable connection even though in either case the rotational direction of the armature 27 of drive motor 9 is the same.

Therefore, with such configuration it is possible that an element of the planetary gear set which is connected to the conversion mechanism can be used to transfer torque to the output spindle 11 and to drive it in reverse direction. Reverse rotation of the output spindle 11 can be achieved without reversing the rotational direction of the armature 27 and without a complicated mechanical assembly added to the drive train. Instead simply the first ring gear 39 in the torque path to the conversion mechanism for the hammer mechanism needs to be adapted to assume first and second positions. At the same time a simple option is provided to prevent the output spindle 11 from rotation when the hammer is in chisel mode.

The description of the invention is merely exemplary in nature and, thus, variations that do not depart from the gist of the invention are intended to be within the scope of the invention. Such variations are not to be regarded as a departure from the scope of the invention.

The invention claimed is:

1. A pneumatic hammer comprising:

a housing (3), a drive motor (9) arranged in the housing (3), an output spindle (11) supporting a tool holder (13) for supporting a tool bit (15), a hammer mechanism comprising a cylinder (17) in which a reciprocatingly driven piston (19) and a ram (23) are arranged wherein in the cylinder (17) an air cushion is formed between the piston (19) and the ram (23) so that the ram (23) reciprocates upon reciprocating movement of the piston (19) and imparts impacts on a tool bit (15) supported in the tool holder (13), a conversion mechanism comprising a rotatable input member coupled to the drive motor (9) and being adapted to convert a rotational movement of the input member into a reciprocating movement of an output member (51) which is coupled with the piston (19), wherein the spindle (11) is coupled with a rotatable drive member coupled with the drive motor (9) so that rotation of the drive member effects rotation of the spindle (11), wherein the input member is formed as a first carrier (33) which eccentrically supports a rotatable first planet gear (35) and is rotatable around a first axis of rotation (31), wherein a first sun gear (37) is coaxially arranged with the first carrier (33) and meshingly engages with the first planet gear (35), the first sun gear (37) being rotatingly driven by the drive motor (9), wherein a first ring gear (39) is coaxially arranged with the first axis of rotation (31), is movable parallel to the first axis of rotation (31) between a first position and a second position and in the first and second positions meshingly engages with the first planet gear (35), wherein the drive member is formed as a second gear (57) rotatable around a second axis of rotation (55) parallel to the first axis of rotation (31), wherein the second gear (57) meshingly engages with the first ring gear (39) when the first ring gear (39) is in the second position, and is disengaged from the first ring gear (39) when the first ring gear (39) is in the first position, wherein the second gear (57) comprises a coupling section connected with the drive motor (9) via a releasable connection which has an open state in which the second gear (57) is not rotatingly driven by the drive motor (9), and a closed state in which the second gear (57) is rotatingly driven by the drive motor (9).

2. The pneumatic hammer according to claim 1, wherein the hammer comprises a mode change mechanism which has:

(a) a first setting (hammer drill mode) in which the first ring gear (39) is in the first position and locked with respect to the housing (3) and the connection is in the closed state, (b) a second setting (drill mode) in which the first ring gear (39) is in the first position and freely rotatable with respect to the housing (3) and the connection is in the closed state, (c) a third setting (chisel mode) in which the first ring gear (39) is in the first or second position and locked with respect to the housing (3) and the connection is in the open state, and (d) a fourth setting (reverse rotation mode) in which the first ring gear (39) is in the second position and rotatable with respect to the housing (3) and the connection is in the open state.

3. The pneumatic hammer according to claim 2, wherein means are provided which are adapted to selectively lock or to allow rotation of the first ring gear (39) with respect to the housing (3) when the first ring gear (39) is in the first position or in the second position.

4. The pneumatic hammer according to claim 3, wherein the first ring gear (39) when being in the first position can be switched between a locked position in which the first ring gear (39) is locked with respect to the housing (3), and a release position in which the first ring gear (39) is freely rotatable with respect to the housing (3), wherein in the first setting the first ring gear (39) is in the locked position, wherein in the second setting the first ring gear (39) is in the release position and wherein in the third setting when the first ring gear (39) is in the first position the first ring gear (39) is in the locked position.

5. The pneumatic hammer according to claim 3, wherein the first ring gear (39) when being in the second position can be switched between a locked position in which the first ring gear (39) is locked with respect to the housing (3), and a release position in which the first ring gear (39) is freely rotatable with respect to the housing (3), wherein in the third setting when the first ring gear (39) is in the second position the first ring gear (39) is in the locked position, wherein in the fourth setting when the first ring gear (39) is in the second position the first ring gear (39) is in the release position.

6. The pneumatic hammer according to claim 2, further comprising a means for locking the first carrier (33) with respect to the housing (3) when the mode change mechanism is in the fourth setting.

7. The pneumatic hammer according to claim 1, wherein the coupling section of the second gear (57) is formed as a second carrier (59) which supports eccentrically with respect to the second axis of rotation (55) a rotatable second planet gear (61)

wherein a second sun gear (63) is coaxially arranged with the second axis of rotation (55) and meshingly engages with the second planet gear (61), the second sun gear (63) being rotatingly driven by the drive motor (9), wherein a second ring gear (65) is coaxially arranged with respect to the second axis of rotation (55) and meshingly engages with the second planet gear (61).

8. The pneumatic hammer according to claim 7, wherein in the closed state of the connection the second ring gear (65) is locked with respect to the housing (3), and wherein in the open state of the connection the second ring gear (65) is freely rotatable with respect to the housing (3).

9. The pneumatic hammer according to claim 7, wherein on the first sun gear (37), a first gear element (67) is formed on the side opposite the first carrier (33), wherein on the second sun gear (63) a second gear element (69) is formed on the side opposite the second carrier (59) and wherein the first and the second gear elements (67, 69) may meshingly engage.

10. The pneumatic hammer according to claim 9, wherein in the closed state of the connection the first gear element (67) is in meshing engagement with the second gear element (69) and wherein in the open state of the connection the first gear element (67) and the second gear element (69) are disengaged.

11. The pneumatic hammer according to claim 10, wherein second gear element (69) is movable along the second axis of rotation (55) between a first position, in which the second gear element (69) meshingly engages with the first gear element (67), and a second position in which the first and second gear elements (67, 69) are disengaged.

12. The pneumatic hammer according to claim 7, wherein on the first sun gear (37) a third carrier (41) is formed opposite the first carrier (33), wherein the third carrier (41) supports eccentrically with respect to the first axis of rotation (31) a rotatable third planet gear (43), wherein a third sun gear (45) is coaxially arranged with the first axis of rotation (31) and meshingly engages with the third planet gear (43), the third sun gear (45) being coupled to an armature (27) of the drive motor (9), wherein a third ring gear (47) is coaxially arranged with the first axis of rotation (31) and meshingly engages with the third planet gear (43), the third ring gear (47) being locked with respect to the housing (3).

13. The pneumatic hammer according to claim 1, wherein an eccentric pin (49) is provided on the first carrier (33) opposite to the first planet gear (35) and wherein a connecting rod (51) connects the eccentric pin (49) and the piston (19) and forms the output member.

14. The pneumatic hammer according to claim 1, wherein the drive member is formed as a bevel gear (53) which engages with a spindle bevel gear (29) coupled to the spindle (11) and having a third axis rotation (21) perpendicular to the second axis of rotation (55).

15. The pneumatic hammer according to claim 14, wherein the spindle bevel gear (29) surrounds the spindle (11).

16. The pneumatic hammer according to claim 1, wherein the output spindle (11) is formed as a hollow spindle having at the end opposite the tool holder (13) a tubular portion and wherein the cylinder (17) is formed by the tubular portion.

* * * * *